United States Patent [19]

Claassens et al.

[11] 4,277,715

[45] Jul. 7, 1981

[54] ELECTRIC GAS DISCHARGE LAMP

[75] Inventors: Jacobus M. M. Claassens; Bart van der Leeuw; Nicolaas F. van Elderen, all of Eindhoven, Netherlands

[73] Assignee: U.S. Philips Corporation, New York, N.Y.

[21] Appl. No.: 36,618

[22] Filed: May 7, 1979

Related U.S. Application Data

[63] Continuation of Ser. No. 846,220, Oct. 27, 1977, abandoned.

[30] Foreign Application Priority Data

Nov. 2, 1976 [NL] Netherlands ..... 7612120

[51] Int. Cl.[3] ..... H01J 61/30; H01J 61/36

[52] U.S. Cl. ..... 313/220; 313/25; 313/318

[58] Field of Search ..... 313/25, 184, 220, 318

[56] References Cited

U.S. PATENT DOCUMENTS

| | | | |
|---|---|---|---|
| 3,450,924 | 6/1969 | Knochel et al. | 313/184 |
| 3,485,343 | 12/1969 | Jorgensen | 313/25 X |
| 3,531,853 | 10/1970 | Klomp | 313/220 X |
| 3,609,437 | 9/1971 | Tol et al. | 313/220 |
| 3,693,007 | 9/1972 | Kerekes | 313/318 |
| 3,832,590 | 8/1974 | Yamazaki et al. | 313/220 X |
| 3,886,392 | 5/1975 | Barakitis et al. | 313/220 |
| 3,892,993 | 7/1975 | Timmermans | 313/25 X |
| 4,034,252 | 7/1977 | McVey | 313/220 X |
| 4,052,635 | 10/1977 | Jacobs et al. | 313/25 X |

*Primary Examiner*—Palmer C. Demeo
*Attorney, Agent, or Firm*—Robert S. Smith

[57] ABSTRACT

A electric gas discharge lamp having a tubular ceramic discharge vessel which is provided at one end with a ceramic end plug which extends axially outside the end of the discharge vessel. The outside diameter of the projecting portion of the end plug being not more than 90% of the outside diameter of the discharge vessel.

3 Claims, 4 Drawing Figures

ELECTRIC GAS DISCHARGE LAMP

Figure 1:
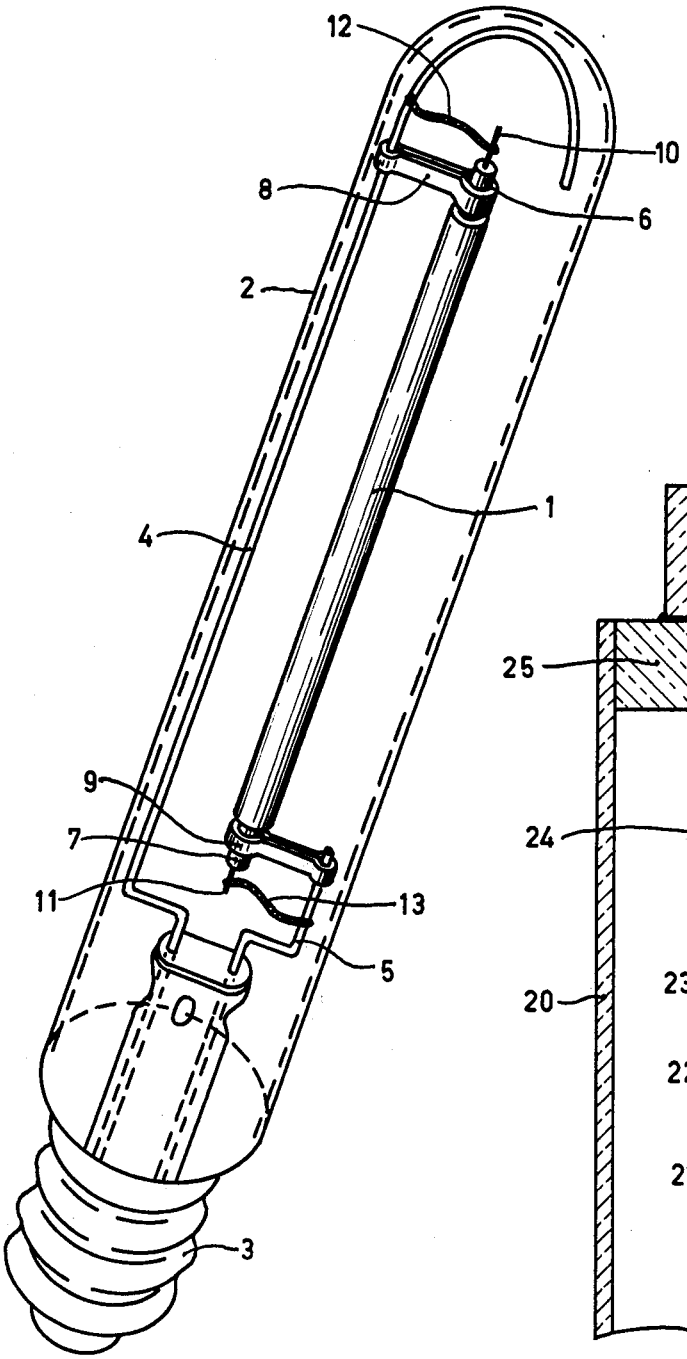

This is a continuation of application Ser. No. 846,220, filed Oct. 27, 1977, now abandoned.

The invention relates to an electric gas discharge lamp having a tubular ceramic discharge vessel which is closed at at least one end with a ceramic end plug which extends to outside the end in the axial direction of the discharge vessel. Dutch patent application No. 6704681 which has been laid open to public inspection discloses such a lamp.

With gas discharge lamps which have a high operating temperature—for example 1000° C. or higher—the discharge vessel consists of ceramic material; this material may be both crystalline material (such as transparent densely sintered aluminiumoxide) and monocrystalline material (such as sapphire). The discharge vessel is usually closed by ceramic end plugs; they may, for example, be connected vacuum-tight to the tube wall of the discharge vessel by means of a fusible ceramic or by sintering. A current-feedthrough component of the electrode is included in the end plug, for example by means of a fusible ceramic. Such current-feedthrough components preferably consist of a metal having a linear coefficient of expansion which is approximately equal to that of the ceramic material or deviates only little therefrom such as niobium or, if the thickness of said current feedthrough element is not chosen too great, molybdenum.

The discharge vessel is supported within an outer bulb by means of so-called pole wires, the ends of which are situated, for example, in the pinched feet of the bulb. The pole wires which generally also perform the function of current supply leads are connected electrically conductive by means of suspension strips to the current feedthrough elements of the electrode, which elements slightly extend from the lamp vessel such as, for example, disclosed in the above-mentioned Dutch Patent Application which has been laid open to public inspection. Such a suspension imposes special requirements on the mechanical strength of the current feedthrough element, particularly when rather vulnerable feedthrough elements of molybdenum are used. In the production of the lamp great care is therefore necessary as deformation and fracture of the current feedthrough elements may easily occur.

U.S. Pat. No. 2,951,959 discloses a discharge lamp wherein the mechanical suspension of the discharge vessel is separated from the electric supply lead of the electrode by fitting a non-conductive suspension strip around the discharge vessel. Such a construction has, when discharge tubes of ceramic are used, the drawback, that owing to the shrinkage and expansion of the discharge vessel stresses occur near the place where the suspension strip and the discharge vessel contact one another which may even result in fracturing of the wall of the discharge vessel. In addition, the heat behaviour in the discharge vessel is negatively affected.

It is an object of the invention to provide a discharge lamp wherein the discharge vessel is secured in the lamp in such a way that the above-mentioned drawbacks are obviated.

A gas discharge lamp of the type mentioned in the preamble has an end plug which extends to outside the end in the axial direction of the discharge vessel and is characterized in accordance with the invention in that the outside diameter of the projection portion of the end plug in not greater than 90% of the outside diameter of the discharge vessel adjacent the end plug, the projection portion being provided with a suspension element of the discharge vessel.

A suspension element can be easily applied around the constricted, extending portion without affecting the heat behaviour in the discharge vessel. A construction according to the invention offers the possibility, by allowing a small clearance between the projection portions of the end plugs and the suspension strips the discharge vessel can be allowed slight movement both in its longitudinal direction and in its transverse direction so that the influence of the expansion and the shrinkage is further mitigated. In a lamp according to the invention the suspension means of the discharge vessel may be separated from the current feedthrough element of the electrode. The current feedthrough element of the electrode which is present in the end plug may, owing to the above-said separated suspension and current supply functions, consist of a pin or wire of a small diameter as is especially the case when metals are used, whose coefficient of expansion slightly deviates from that of the ceramic material. An example of such a metal is molybdenum.

In an embodiment of a gas discharge lamp according to the invention the end plug comprises at the end which faces away from the discharge vessel a thickened portion which contacts the discharge vessel. The thickened portion which consists fo a piece of ceramic material which is sintered to the end plug prevents sagging of the cover element in the discharge vessel during production of the lamp.

The current feedthrough element of an electrode, present in the end plug may, for example, consist of a tube of niobium, tantalum, tungsten or molybdenum or alloys thereof, or of a rolled-up foil as described in Dutch patent application No. 7414846 which has been laid open to public inspection.

An embodiment of a lamp according to the invention wherein a current feedthrough element of an electrode is present in the end plug and projects from the end plug external to the vessel, is characterized in that the current feedthrough element is provided on its projecting portion with positioning means for directly or indirectly supporting the end plug. This has the advantage that the position of the electrode during fabrication of the lamp can be accurately adjusted to the proper distance from the end plug. Namely, when the current feedthrough element is applied in the end plug by means of a sealing glass, the positioning means enables the element to be accurately located in the end plug.

In accordance with the invention such positioning means may, for example, be a wire wound helically around the projecting portion of the current feedthrough element. In another embodiment the positioning means may be a radially extending flange fitted to the current feedthrough element.

In a special embodiment in which the current feedthrough element is a conductor in the form of a wire the positioning means is formed by the end of the current feedthrough wire which is bent towards the discharge vessel and which bears on the end of the complete discharge vessel assembly, for example, be the end plug or the discharge vessel itself. With such a construction the current-carrying wire which connects the current feedthrough element to the resulting loop can be connected in a simple manner to the outside of the discharge vessel.

The invention will be further exmplained with reference to a drawing in which:

FIG. 1 shows a discharge lamp according to the invention and

Figure 2:
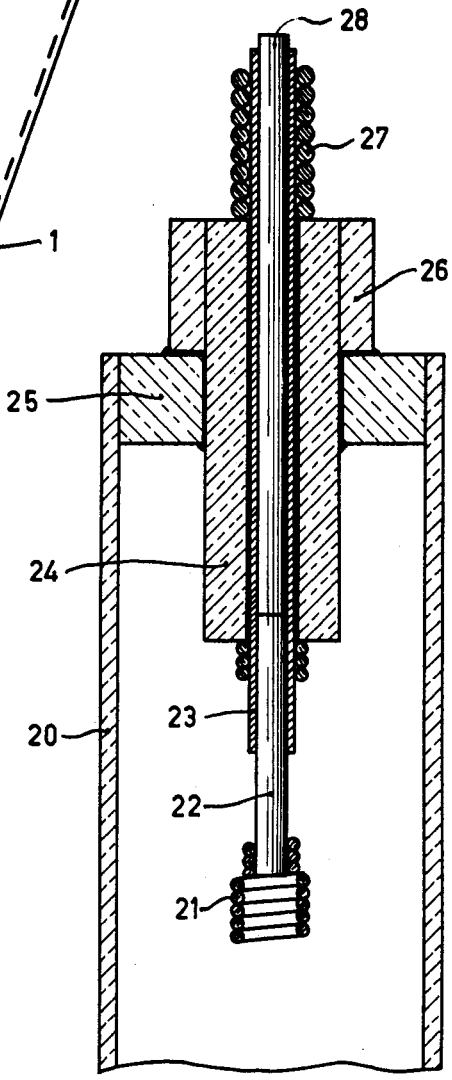
Figure 3:
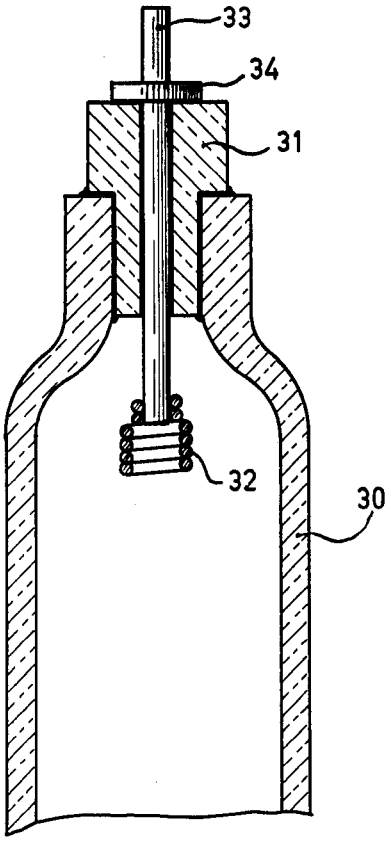
Figure 4:
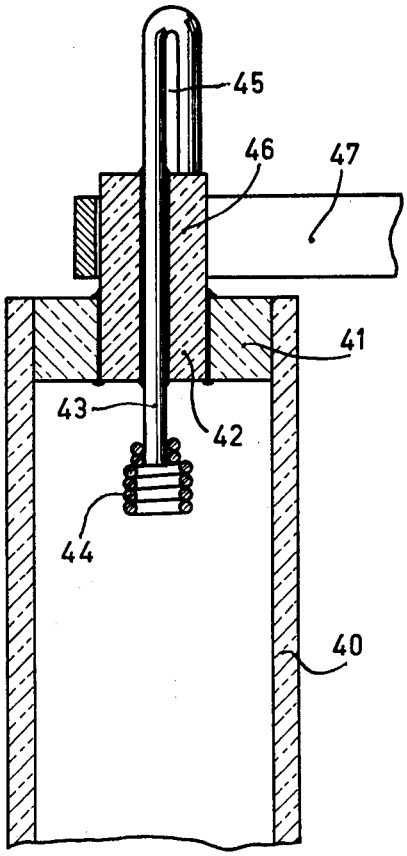

FIGS. 2 to 4 inclusive show a longitudinal section through one end of a discharge vessel.

In FIG. 1 reference 1 indicates a ceramic discharge vessel of a 400 W high-pressure halide discharge lamp. Reference 2 indicates the outer bulb of this discharge lamp. Reference 3 indicates the lamp base. References 4 and 5 indicate the pole wires. In situ of the end plug the discharge vessel is suspended at the extending ceramic portions 6 and 7 respectively by means of strip-shaped suspension elements 8 and 9 respectively. These strip-shaped elements are formed as strips of material which surround the reduced diameter projection portion of the end plug which extends outside the discharge vessel with some clearance. The term "clearance" will be understood to refer to an annular space intermediate one of the strip-shaped suspension elements 8, 9 and the reduced diameter projection portion of the end plug when the two are disposed in coaxial relationship. Since these elements are ordinarily not positioned in coaxial relationship the dimensional relationship may perhaps better be described as one where the strip-shaped suspension elements 8, 9 have an arcuate portion having a radius of curvature which is greater than one-half the outside diameter of the part of the end plug with which it cooperates and less than one-half the diameter of the discharge vessel 1. The discharge vessel 1. The discharge vessel 1 is then suspended in a slightly movable manner, that is to say the vessel can move slightly between the suspension strips 8 and 9 without being able to free itself from these strips because of the larger diameter of the discharge vessel. The current feedthrough elements 10 and 11 respectively are connected by means of current lead wires 12 and 13 to the pole wires.

In FIG. 2 reference 20 indicates a portion of the discharge vessel 1 of FIG. 1. This discharge vessel is made of transparent gas-tight densely sintered aluminium oxide. Besides a halide the filling of the vessel contains for example an iodide, also mercury and a starting gas, for example argon. Reference 21 indicates an electrode which is electrically connected through a tungsten bar 22 to a current feedthrough element 23. This current feedthrough element consists of a rolled-up foil of molybdenum having a thickness of 50$\mu$ and is fastened by means of sealing glass to the ceramic end plug 24 which is fastened by means of sealing glass to an annular second ceramic preform 25 which is here assumed to form part of the discharge vessel 20 and is sintered thereto. The portion of the end plug which extends to outside the discharge vessel is provided with a collar 26 which bears against the portion 25 of the discharge vessel 20 and contacts the discharge vessel and which consists of a ceramic ring which is sintered to 24 to form a T-shaped end plug. The entire outside diameter of the portion of the end plug which projects beyond the end of the discharge vessel amounts to approximately 60% of the outside diameter of the discharge vessel adjacent the end plug. Connected to the current feedthrough element 23, which projects outwardly of the discharge vessel from end plug 24, 26, is a wire helix 27 resting on the end plug. The hollow cylindrical current feedthrough element 23 is filled up on the inside with a ceramic preform 28 but it is alternatively possible to use a fusible ceramic or a suitable sealing glass for this purpose.

In FIG. 3 the discharge vessel, which slightly tapers, is indicated by 30. The ceramic end plug is indicated by 31 and has the form of a T. The current feedthrough element of the tungsten electrode 32 consists of a molybdenum pin 33 having a diameter of not more than 600 $\mu$m. A transverse flange 34 is provided on this pin the outside the discharge vessel abutting end plug 31 to provide a means for positioning the electrode with respect to end plug 31 during assembly.

In FIG. 4 the ceramic discharge vessel is indicated by 40. In the annular rim 41 which is connected by means of sintering to the discharge vessel an end plug 42 is disposed in which a wire-shaped molybdenum current feedthrough element 43 having a diameter of approximately 600 $\mu$m for the tungsten electrode 44 is disposed. The current feedthrough element 43 is resting on the end plug 42 by bending its end. Optionally, the element also can rest directly on the piece 41 of the discharge vessel. In the opening 45 thus obtained there is room for a connection of the currents lead wire to the pole wire. The outside diameter of the extending portion 46 of the end plug 42 which is fitted to the cover piece 41 by means of a sealing glass amounts to approximately 40% of the outside diamter of the discharge vessel 40. A suspension strip 47 is applied with some clearance around this projecting portion 46.

In the foregoing embodiments the outside diameter of the projection portion of each end plug may be increased to, but not beyond 90% of the outside diameter of the discharge vessel.

What is claimed is:

1. An electric gas discharge lamp which comprises: means for suspending a discharge vessel, a tubular ceramic discharge vessel including at least an end face having a generally axially aligned hole therein and a ceramic end plug which has a first portion having a circumferential surface having a gas tight seal with said hole and which extends axially within said one end face of said discharge vessel, said first portion cooperating directly or indirectly with said means for suspending, said lamp further including at least two electrodes.and an ionizable medium in said discharge vessel, said end plug further including adjacent to said first portion an axially adjacent second portion extending away from said discharge vessel, said second portion having an outside diameter greater than said first portion, said second portion contacting said end face, said second portion of said end plug having an outside diameter not greater than 90% of the outside diameter of the discharge vessel, said means for suspending including an arcuate member formed from a strip of material which is disposed surrounding said second portion of said end plug, said arcuate member having a radius of curvature which is greater than one-half the outside diameter of said second portion of said end plug and less than one-half of the diameter of said discharge vessel, said arcuate member not conducting electricity to any of said electrodes.

2. An electric gas discharge lamp as claimed in claim 1, further including a current feedthrough element for an electrode disposed in said end plug which projects externally from said end plug, said element including positioning means which abuts said end plug, said positioning means being a wire wrapped helically around said feedthrough element.

3. An electric gas discharge lamp as claimed in claim 1, wherein said current feedthrough element is a wire-shaped conductor, said positioning means being formed from the end of said current feedthrough element which has a portion bent towards said discharge vessel and extends to said end plug.

* * * * *